US009841232B2

(12) United States Patent
Chapman

(10) Patent No.: US 9,841,232 B2
(45) Date of Patent: Dec. 12, 2017

(54) APPARATUS AND SYSTEM FOR THREE DIMENSIONAL INFRARED GRADIENT HEATING FOR CURING POWDER COATINGS ON POROUS WOOD PRODUCTS

(71) Applicant: Michael J. Chapman, Portsmouth, RI (US)

(72) Inventor: Michael J. Chapman, Portsmouth, RI (US)

(73) Assignee: Heraeus Noblelight GmbH, Hanau (DE)

( * ) Notice: Subject to any disclaimer, the term of this patent is extended or adjusted under 35 U.S.C. 154(b) by 710 days.

(21) Appl. No.: 14/341,827

(22) Filed: Jul. 27, 2014

(65) Prior Publication Data

US 2015/0034248 A1 Feb. 5, 2015

Related U.S. Application Data

(60) Provisional application No. 61/860,836, filed on Jul. 31, 2013.

(51) Int. Cl.

| | |
|---|---|
| ***F27D 11/00*** | (2006.01) |
| ***F26B 3/30*** | (2006.01) |
| *B05D 3/02* | (2006.01) |
| *B05D 7/06* | (2006.01) |
| *B27N 7/00* | (2006.01) |

(52) U.S. Cl.

CPC ..... *F26B 3/305* (2013.01); *F26B 3/30* (2013.01); *B05D 3/0263* (2013.01); *B05D 7/06* (2013.01); *B05D 2401/32* (2013.01); *B27N 7/005* (2013.01); *F26B 2210/16* (2013.01)

(58) Field of Classification Search

CPC . F26B 3/30; F26B 23/024; F26B 3/305; F24J 1/00; B05D 3/0263

USPC ..... 431/328

See application file for complete search history.

(56) References Cited

U.S. PATENT DOCUMENTS

| | | | | |
|---|---|---|---|---|
| 6,494,712 | B1 * | 12/2002 | Charmes | F23D 14/18 392/432 |
| 7,159,535 | B2 * | 1/2007 | Chapman | B05D 3/0254 118/50.1 |
| 2011/0123940 | A1 * | 5/2011 | Szynkarczuk | B01J 23/38 431/278 |

* cited by examiner

*Primary Examiner* — Steven B McAllister
*Assistant Examiner* — Ko-Wei Lin

(57) ABSTRACT

The present invention has to do with an apparatus for generating a three dimension heating gradient field for curing powder coated wood products. The three dimension heating gradient field is generated with catalytic heater panels having independently adjustable angles and adjustable heat outputs.

17 Claims, 8 Drawing Sheets

APPARATUS AND SYSTEM FOR THREE DIMENSIONAL INFRARED GRADIENT HEATING FOR CURING POWDER COATINGS ON POROUS WOOD PRODUCTS

CROSS-REFERENCE TO RELATED APPLICATIONS

The present application is related to, claims the earliest available effective filing date(s) from (e.g., claim earliest available priority dates for other than provisional patent applications; claims benefits under 35 USC §119(e) for provisional patent applications), and incorporates by reference in is entirety all subject matter of the following listed application(s) (the "Related Applications") to the extent such subject matter is not inconsistent herewith; the present application also claims the earliest available effective filing date(s) from, and also incorporates by reference in its entirety all subject matter of any and all parent, grandparent, great-grandparent, etc. applications of the Related Application(s) to the extent such subject matter is not inconsistent herewith:

1. U.S. provisional patent application 61/860,836 entitled "An Apparatus and System for Three Dimensional Infrared Gradient Heating and Curing Powder Coatings on Porous Wood Products", naming Michael J. Chapman as inventor, filed 31 Jul. 2013.

BACKGROUND

1. Field of Use

This invention relates to an improved apparatus for heating and curing powder coatings on porous wood products, such as medium density fiberboard (MDF). More specifically, the invention relates an improved catalytically powered oven employing a novel arrangement of infrared catalytic heaters for heating and curing powdered coatings on MDF board.

2. Description of Prior Art

For the past twenty-five years, the powder coating of metal parts has become a popular method of finishing. There are numerous suppliers of powder coating catering to all segments of the metal industry; ranging from automotive to architectural to marine applications. A typical method of applying powder to metal parts is to charge the powder particles with a charge via a spray gun. These charged particles are then attracted to metal parts that are earthed via a grounded hanging device on a conveying system.

Wood, or engineered wood products (EWP), such as medium density fiberboard (MDF) are not naturally as conductive as typical metal parts. MDF is made conductive by preheating, for up to 3 minutes, the MDF to a range that is between about 150 and 250 degrees Fahrenheit. Preheating the MDF activates the moisture content of the MDF (typically about 5-10%) causing it to become conductive. Thus, charged powder will attach to a properly grounded MDF board.

Once the powder is attached to the MDF board, the method of curing has been by either heating the powder in a convection oven for a certain period of time or by infrared heat for a period of time that is less than that of a convection oven. The infrared heat source has been either electric resistance heaters or catalytic heaters. In recent years, catalytic heaters have attracted considerable attention as the preferred choice of infrared heat sources.

MDF board is available in various thicknesses ranging from one-quarter (¼) inch through to two inches, for example. With all thicknesses, the face surfaces of the MDF board are of a considerable higher density than the core of the board. The greater the thickness of the MDF board, the greater the difference is between the core density and the face surface density. MDF board has a certain amount of naturally occurring porosity within the board structure and hence a characteristic moisture content. The greater the thickness, the greater the porosity due to the lower core density.

Curing powder coatings on medium density fiberboard (MDF) using an infrared heat source has given rise to certain difficult problems. When heating a piece of powder coated MDF board to cause the powder to cure, the board is typically hanging in a vertical position. As the board heats up, the entrapped moisture expands and out-gases through the edges of the board, typically from the center of the core in the area of lowest density. During the curing process using a conventional catalytic heating oven, the face surfaces of the board are easily heated, while the edges, especially the vertical edges, do not receive a full direct line of site of infrared energy. As a result, the edges of the board are the last to cure as compared to the face surfaces. This leads to an occurrence where the expanding moisture, which is out-gassing from inside the board, bubbles and forms blisters along the side edges of the board. These blisters occur because the powder at the edges has not reached a degree of cure, as compared to the face of the board, which would prevent the blisters from forming.

Furthermore, powder coatings, going through the curing process, first turn to liquid and then a gel stage followed by a curing stage where the powder reaches its full cured properties. However, the liquefied powder will be drawn into the edges of the MDF in a similar manner to edge grain on wood absorbing liquids. Consequently, wood fibers appear and present an undesirable different look and feel to that of the coated and cured face sides of the MDF board and EWP's.

Depending on the method of cutting and sanding of the edges of the MDF board the wood fibers will protrude in varying degrees. The degree of this protrusion is dependent on the density across the board thickness and a umber of other factors to do with the physical properties of the board—fiber type and length, percentage and type of glue used, and the MDF board and the EWP's manufacturing process in general.

Thus, the manufacturing and pre-finishing processes for the MDF board, along with the precise application of the powder thickness on the edges, all contribute too many variables that may produce sub-standard edge finishes, resulting in waste and low yields.

To compensate for the issues associated with powder coating the edges of MDF boards the present state of the art employs both a single coat application and a two coat application. In both applications it is the vertical edges that are required to receive a predominate level of infrared heat to allow the powder to flow, seal and cure the edges ahead of the face sides of the board. Generally, a powder prime coat is applied to the edges and faces of the MDF, partially cured, followed by a powder top coat and then the two coats are co-cured together. The end result provides an acceptable edge finish that mitigates, but doesn't eliminate the undesirable variables mentioned above.

Thus, there exists a need for a system and method for the edge treatment of MDF boards and EWPs to maintain a high quality powder coated MDF board while reducing associated manufacturing expenses.

BRIEF SUMMARY

The foregoing and other problems are overcome, and other advantages are realized, in accordance with the presently preferred embodiments of these teachings. The present invention provides a novel and improved apparatus for curing powder coatings on the face of porous wood products, such as medium density fiberboard (MDF), by employing dynamically angled catalytic heater panels that are disposed to apply heat onto the side edges of the board and thus induce a greater degree of curing the coating before the bubbles or blisters are allowed to form.

The catalytic heater panels, having multiple heating zones, are also arranged such that infrared energy or heat is directed onto the face of the board at an angle of incidence sufficient to produce a gradient of applied heat across the coating from one side edge to the other, thus assuring a uniform heating and curing of the coating.

In addition, dynamically angling the catalytic heater panels allows for fewer heating panels than used in prior art solutions while simultaneously curing the powder coating on the face and edges of the MDF board but before bubbles or blisters are allowed to form on the leading or trailing edges of the MDF board.

The invention is also directed towards an apparatus with a controller for generating three dimensional infrared gradient heating fields for curing powder coating on a three dimensional powder coated wood product having low and high density zones. The apparatus also includes at least one first catalytic heater element or generating infrared heat incident upon the powder coated wood product and at least one second catalytic heater element for generating infrared heat incident upon the powder coated wood product. The at least one first catalytic heater element and the at least one second catalytic heater element are cooperatively disposed within the apparatus to generate a proportional three dimensional (3D) gradient heating zone when the heater elements are operational. The 3D gradient heating zone is adjustable to substantially cure the powder coated low density zones before substantially curing the powder coated high density zones as the 3D powder coated wood product is conveyed through the apparatus.

A system for generating three dimensional infrared gradient heating fields for curing powder coating on a powder coated wood product in accordance with the invention is provided. The powder coated wood product includes multiple relatively lower and higher density zones, and the powder coated wood product is conveyed through the system by a conveyor. The system includes a plurality of plenum chambers, wherein each of the plurality of plenum chambers is sufficient to permit between about 200 volume changes per hour at a gas flow rate of about 3 cubic feet per square foot per hour and 800 volume changes at a gas flow rate of about 6 cubic feet per square foot per hour. The system also includes at least one controller for independently adjusting gas flow rate through each of the plurality of plenum chambers. In addition, there are a plurality of catalytically active layers, and each of the plurality of catalytically active layers is in gaseous communication with a corresponding one of the plurality of plenum chambers. The plurality of catalytically active layers are disposed relative to each other to generate a three dimensional infrared heat field. The independent gas flow rates and the disposition of the plurality of catalytically active layers result in a three dimensional temperature gradient field, adaptable to substantially cure powder coatings within the relatively lower density zones before curing powder coatings within the higher density zones.

The invention is also directed towards an apparatus with a controller for generating three dimensional infrared gradient heating fields for curing powder coating on a three dimensional powder coated wood product having multiple relatively lower and higher density zones, and wherein the powder coated wood product is conveyed through the apparatus by a conveyor. The apparatus includes at least one catalytic heater element for generating infrared heat incident upon the powder coated wood product at a first incidence angle; and at least one second catalytic heater element for generating infrared heat incident upon the powder coated wood product at a second incidence angle. In addition, the at least one first catalytic heater element and the at least one second catalytic heater element are cooperatively disposed within the apparatus to generate proportional three dimensional gradient heating zones when the heater elements are operational. The three dimensional temperature heating zones are adaptable to substantially cure powder coatings within the relatively lower density zones before curing powder coatings within the higher density zones as the powder coated wood product is conveyed through the three dimensional temperature heating zones.

BRIEF DESCRIPTION OF THE DRAWINGS

The subject matter which is regarded as the invention is particularly pointed out and distinctly claimed in the claims at the conclusion of the specification. The foregoing and other objects, features, and advantages of the invention are apparent from the following detailed description taken in conjunction with the accompanying drawings in which:

DETAILED DESCRIPTION

The following brief definition of terms shall apply throughout the application:

The term "outer" or "outside" refers to a direction away from a user, while the term "inner" or "inside" refers to a direction towards a user;

The term "comprising" means including but not limited to, and should be interpreted in the manner it is typically used in the patent context;

The phrases "in one embodiment," "according to one embodiment," and the like generally mean that the particular feature, structure, or characteristic following the phrase may be included in at least one embodiment of the present invention, and may be included in more than one embodiment of the present invention (importantly, such phrases do not necessarily refer to the same embodiment);

If the specification describes something as "exemplary" or an "example," it should be understood that refers to a non-exclusive example; and If the specification states a component or feature "may," "can," "could," "should," "preferably," "possibly," "typically," "optionally," "or example," or "might" (or other such language) be included or have a characteristic, that particular component or feature is not required to be included or to have the characteristic.

Figure 1:
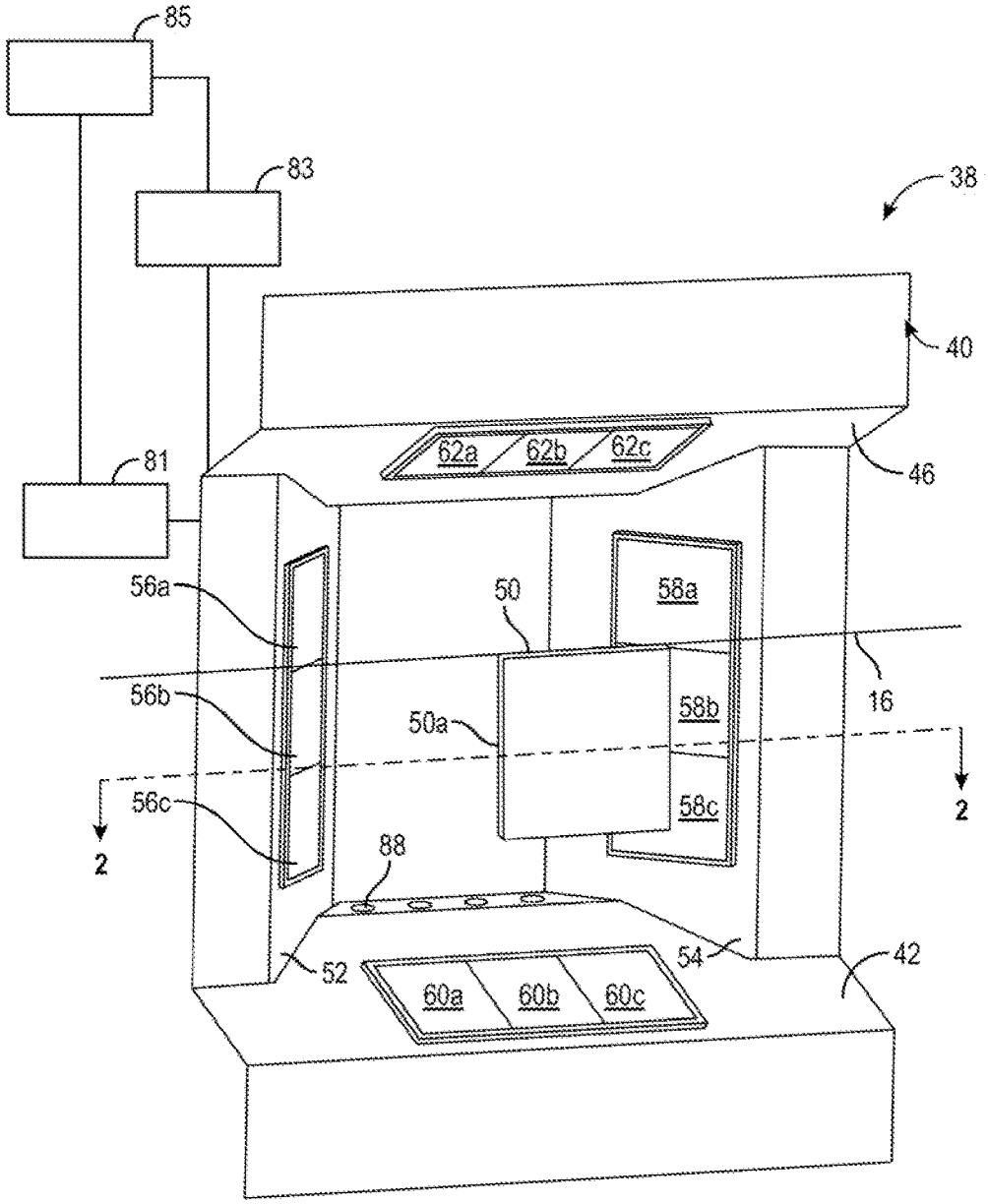
FIG. 1 is an elevated perspective view of one-half section of a catalytically powered oven according to the invention. The other-half section of the oven, which is not shown in the drawing, is a mirror image of the half-section that is shown in FIG. 1. In practice, the two-half sections are joined together along a centerline to continuously treat coatings on both sides of a vertically hanging piece of porous fiberboard.
Figure 2:
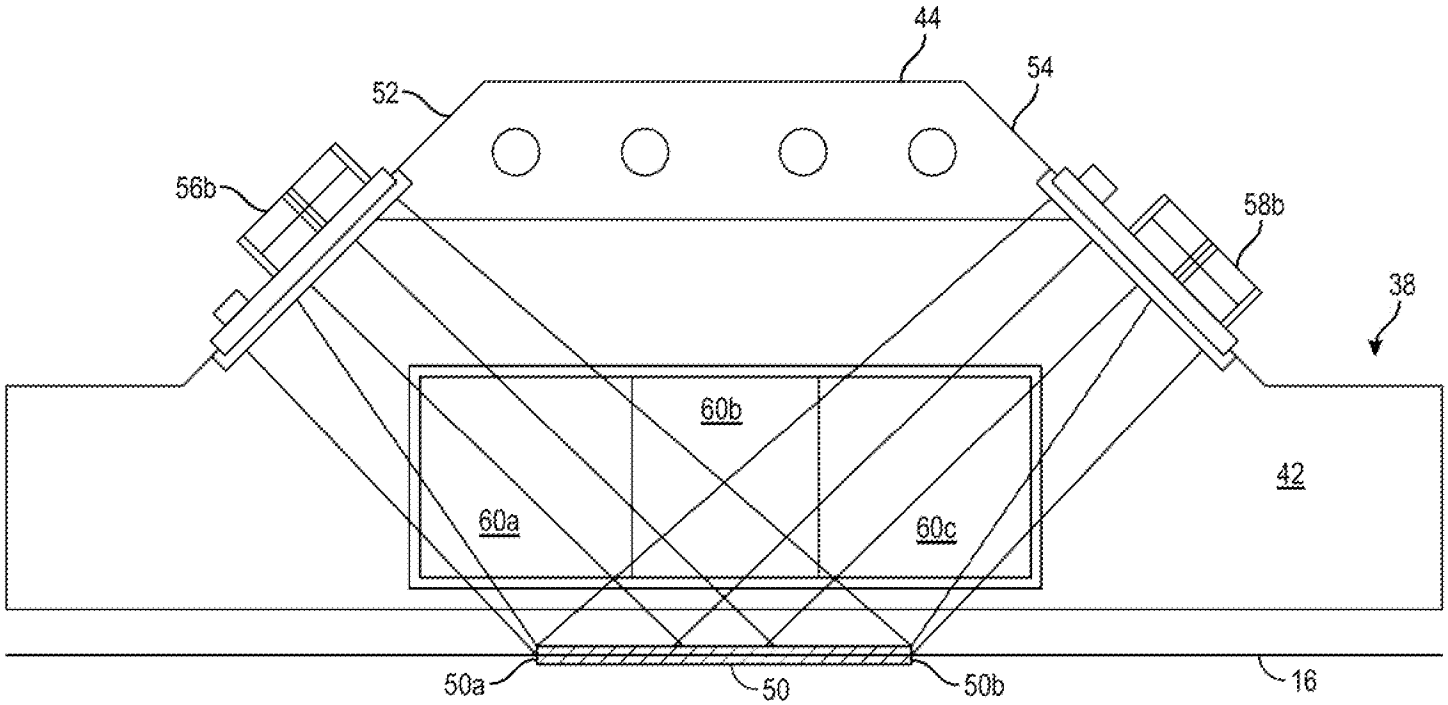
FIG. 2 is a cross-sectional view of the improved catalytic oven of the invention taken through the line 4-4 in FIG. 3.

The aforementioned problem are effectively overcome by the improved apparatus of the invention which is illustrated in FIGS. 1 and 2 of the drawings. The half-section of the improved catalytically powered oven of the invention is shown generally at 38 and comprises a framework 40 which is somewhat similar to that employed in a conventional oven. The framework 40 includes a base panel 42, a back panel 44 and an overhead panel 46. The other half-section of the oven, which is not shown in the drawing, is a mirror image of the one-half section 38 that is shown and because the two half-sections are otherwise identical in construction, only the one half-section 38 will be described herein for the sake of simplicity.

The catalytic oven 38 of the invention is further developed to include a pair of outwardly inclined side panels 52, 54. These side panels 52, 54 are affixed to the back panel 44 and extend between the base panel 42 and the overhead panel 46.

The side panels 52, 54 each support a single vertical catalytic heater panel consisting of a column of three catalytic heaters 56*a*-56*c* and 58*a*-58*c*, respectively. As best shown in the view of FIG. 2, these catalytic heaters 56*a*-56*c* and 58*a*-58*c* are set at an initial predetermined angle along a vertical axis that is parallel to the vertical side edges of the board 50. It will be appreciated that the angle of the catalytic heater panels with relation to the position of the MDF board 50 determines the amount of infrared heat applied to the edge 50A and face 50D of MDF board 50. Typically, these catalytic heaters are spaced from the face and side edges of the board a distance ranging from between about 24 inches to about 60 inches during the time the board passes through the oven.

The fiberboard board 50 is moved along a centerline between the two half-sections that are joined together to heat and cure coatings on both sides of the board. The fiberboard 50 is hung in a vertical position from an overhead conveyor belt 16 and is moved along the centerline at a relatively slow speed, say about 72 to about 180 inches per minute, for example.

The arrangement of the inclined catalytic heaters 56*a*-56*c* and 58*a*-58*c* on the two side panels 52, 54 is further advantageous in that the heaters are each disposed to apply infrared heat across the face of the fiberboard 50 in a gradient that is of the highest intensity at the side edge of the board closest to the heaters and of the lowest intensity at the opposite side edge furthest from the heaters. In other words, the inclined vertical heaters apply heat in two intensity descending patterns across the face of the board which overlap one another and thus assure a uniform heating and curing of the coating.

In the practice of the invention, the two rows of side mounted catalytic heaters 56*a*-56*c* and 58*a*-58*c* are initially inclined along a vertical axis parallel to the side edges of the fiberboard 50 at an angle of between about 30 and 50 degrees, and preferably about 45 degrees, with respect to a vertical plane passing through the board 50. The angle of incidence of infrared heat directed at the surface of the board will be essentially the same as the angle to which each heater is inclined.

The catalytic heater panels, comprising heaters 56*a*-56*c* and 58*a*-58*c* are rotatable to allow for dynamic changing of the angle between 30 and 70 degrees of the catalytic heater panels and are thus arranged cooperatively to apply infrared heat directly onto the opposite vertical side edges and face of the fiberboard 50 as clearly shown in FIG. 2. This arrangement enables the oven to heat and cue the powder coating along the side edges and face of the board using ewer resources than prior art solutions, while preventing the formation of blisters and bubbles along the vertical edges 50A, 50B of the MDF board 50 as it travels through the oven.

As can be seen in FIGS. 1 and 2, there is also provided in the improved catalytic oven of the invention a pair of horizontal rows of three catalytic heaters 60*a*-60*c* and 62*a*-62*c* supported on the base panel 42 and the overhead panel 46, respectively. These two rows of catalytic heaters are inclined along a horizontal axis that is parallel to the bottom and top edges of the vertical hanging fiberboard 50. The catalytic heaters serve to apply heat to the bottom and top edges of the hanging fiberboard. Since heat rises, the bottom heaters operate independently of the top heaters. Typically, the bottom heaters are set considerably higher in output than the top heaters.

The coating material that is applied to the porous fiberboard (MDF) and then heated and cured in accordance with the invention may generally be described as a plastic thermosetting material Examples of such materials include, for instance, polyesters, epoxies and acrylics. The coatings may be applied by conventional methods such as by electrostatic spraying techniques as described before. The thickness of the coatings may vary generally between about 2 and 10 thousands of an inch as indicated depending upon the particular application.

Still referring to FIG. 1, the improved catalytically powered oven 38 also includes a catalytic heater controller 83, a panel angle controller 81, at least one temperature sensing device 88, and a system controller 85 for cooperatively controlling the catalytic heater controller 83 and the panel angle controller 81 in accordance with sensed and predetermined values. For example, the temperature gradient experienced by the MDF board 50 on its face 50D and leading and trailing edges, 50A and 50B, respectively, may be sensed by infrared temperature sensing device 88 wherein the system controller 85 may, via the panel angle controller 81, adjust the angle of the heater panel 56*a-c* and/or heater panel 58*a-c* such that infrared heat incident upon MDF board 50 face 50D and edges 50A and 50B is within a predetermined temperature range. It will be appreciated that the panel angle controller may be pre-programmed to adjust the angle of the heater panel 56*a-c* and/or heater panel 58*a-c*. It will also be appreciated that the panel angle controller may be dynamically controlled to adjust the angle of the heater panel 56*a-c* and/or heater panel 58*a-c*. Finally, it will be understood that that the panel angle controller may be manually controlled to adjust the angle of the heater panel 56*a-c* and/or heater panel 58*a-c*.

In addition system controller 85, via catalytic heater controller 83, may also adjust the gas flow rate to any individual heater panel element to dynamically and cooperatively alter the temperature gradient in three dimensions, e.g., along the vertical face and edges of MDF board 50, along the horizontal face of the MDF board 50, and along the horizontal edge 50A of the MDF board 50. It will be appreciated that system controller 85 may cooperatively alter the temperature gradients in accordance with real time feedback or may be preprogrammed to alter the temperature gradients. It will be understood that in addition to temperature feedback provided by the temperature sensing device 88, system controller may include parameters regarding the MDF board, e.g., type, dimensions, distance from heaters, and powder coat material when determining the cooperative temperature gradients. Also, the system controller calculations may include preprogrammed track 16 speed and/or real time track 16 speeds.

It will further be appreciated that the temperature sensing device 88 may also be a plurality of temperature sensing devices and recorder attached to a test MDF board for recording temperature gradients as the test MDF board travels through oven 38.

It will be appreciated that the catalytic heater elements (e.g., 56*a*) must be constructed such the BTU output of each element is sensitive or responsive to incremental gas flow rates.

Figure 3:
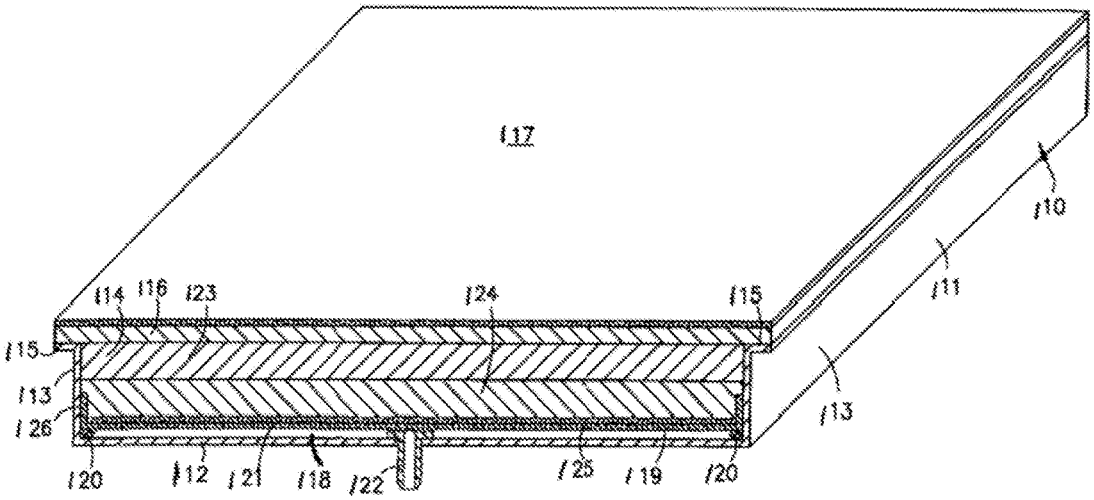
FIG. 3 is a perspective view, partly in section, of a gas catalytic heater element according to the invention.
Figure 4:
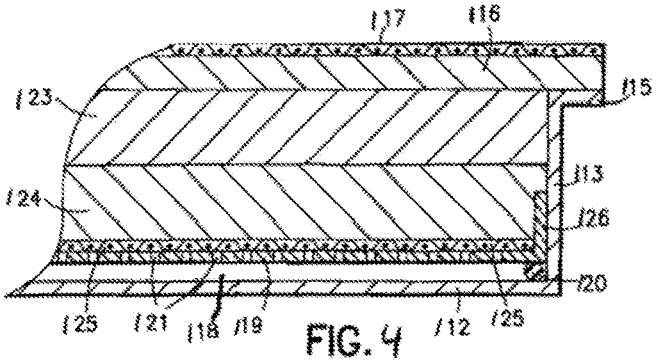
FIG. 4 is an enlarged sectional view of a portion of the gas catalytic heater element shown in FIG. 3.

Referring now to FIGS. 3 and 4, a gas catalytic heater (e.g., 56*a*) is shown. The catalytic heater (e.g. 56*a*) includes a body 110 in the form of a shallow, rectangular shaped metal pan 111 having a flat bottom wall 112, upstanding side walls 113 and an upper open end 114. The open end 114 of the pan 111 is formed with a peripheral flange portion 115 which supports a thin, porous, catalytically active layer 116. This catalytically active layer 116 is made from a fibrous, ceramic material such as silica or alumina, for example, and is infused with an oxidation catalyst such as platinum, palladium or the oxides of chromium, cobalt or copper, or mixtures thereof for example.

It will be appreciated that the oxidation catalyst infusion process must result in an evenly distributed oxidation catalyst throughout the catalytically active layer 116. One method of infusing the catalytically active layer 116 is by immersion in a solution containing a predetermined percentage by weight of platinum or any suitable catalyst. After immersion excess solution may be removed catalytically active layer 116 followed by drying and calcination at a predetermined temperature.

An open wire mesh or screen 117 rests on top of the porous catalytic layer 116 and allows for easy access of air and oxygen to the surface of the catalytic layer 116 from the surrounding atmosphere.

There is provided within the bottom of the catalytic heater a plenum chamber as shown at 118. The plenum chamber 118 is formed by mounting a perforated metal plate 119 in spaced apart relation above the bottom wall 112 of the metal pan 11. The perforated plate 119 rests on a resilient or adhesive bead 120 which is interposed between its outer peripheral edges and the bottom wall 112. The bead 120 serves to separate the plate 119 from the bottom wall 112 and to seal off the plenum chamber 118.

The perforated metal plate 119 contains a plurality of tiny holes or apertures 121 which communicate directly with the interior of the sealed plenum chanter 118. The holes or apertures 121 are substantially evenly spaced apart from one another within the plate 119 as best shown in FIGS. 3 and 4. The size and more particularly the open area provided by the tiny holes or apertures 121 is an important factor to be considered in the practice of the invention as shall be described in greater detail hereinafter.

As shown in FIG. 3, the plenum chamber 118 is relatively shallow in height but extends across the entire bottom of the catalytic heater providing a relatively large space or volume for containing the combustible gas or fuel prior to distribution to the catalytically active layer 116. The gas or fuel is fed to the sealed plenum chanter 118 via a small gas orifice 122 mounted within the bottom wall 112.

Disposed between the porous catalytic active layer 116 and the sealed plenum chamber 118 are two porous fibrous layers 123, 124 of heat insulating material, such as silica fibers, for example. The heat insulating layers 123, 124 thermally isolate the catalytic layer 116 from the bottom of the heater and also aid in distributing the gas evenly as it emerges from the perforated plate 119 prior to reaching the catalyst.

In order to prevent the fibers within the heat insulating layers 123, 124 from reaching and blocking the tiny holes or apertures 121 in the perforated plate 119, a baffle member 125 is disposed between the plate and the adjacent fibrous insulating layer 124. The baffle member 125 may be composed of metal, fiberglass, ceramic or an engineered plastic and can be cast or woven from these materials. The baffle can also be a non-woven material composed of randomly dispersed fibers or other similar structure. In the embodiment of the catalytic heater illustrated, the baffle number 125 is a woven metal mesh or screen.

The main purpose of the baffle number 125 is to prevent the combustible gas or fuel from being obstructed as it leaves the plenum chanter 118 and enters the insulating layers 123, 124. The baffle member also serves to more evenly distribute the gas or fuel as it emerges from the tiny holes or apertures 121.

Figure 6:
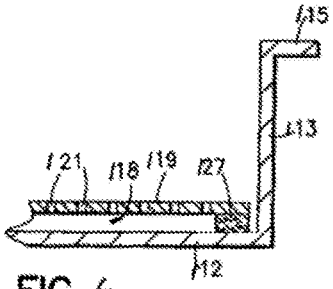
FIG. 6 is a view similar to FIG. 4 showing a different embodiment of the invention.

As shown in the FIGS. 3 and 4 of the drawing, the perforated metal plate 119 may also be formed with an upstanding rim portion 126 which fits snugly against the side walls 113 of the metal pan 111. This rim portion 126 aids in sealing off the plenum chamber 118 and also serves to secure the baffle member 125 within the bottom of the catalytic heater. FIG. 6 shows a different embodiment wherein the rim portion 126 is eliminated and the plenum chamber 118 is sealed off by a rectangular strip 127 of an adhesive type sealant.

Figure 7:
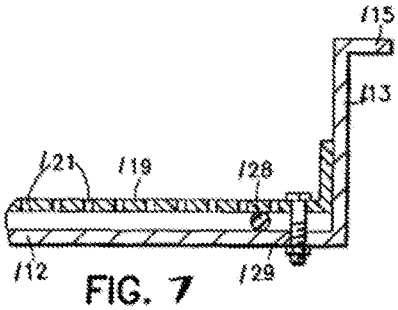
FIG. 7 is a similar view of a gas catalytic heater showing still another embodiment of the invention.

As noted herein above, the sealing bead 120 shown in FIGS. 3 and 4 may also be composed of a resilient material, such as rubber, for example. Such an embodiment is illustrated in FIG. 7 wherein a resilient sealing bead 128 is provided and is compressed into sealing relation between the perforated plate 119 and bottom wall 112 by a bolt and nut 129. The plate 119 in this embodiment also includes the peripheral rim 126 as described above.

Typically, in catalytic heaters that are commercially available today, there is no sealed plenum. A perforated plate is used that covers a gas dispersion tube within the bottom of the heater. This plate is loosely placed, but not sealed, into the heater and supports the insulation layers, electric resistance heaters used to start the catalytic heater and finally the catalyst layer. The entire depth of the heater (approximately two inches) is employed for distributing the gas. The typical volume changes of gas within this space are in the range of about 18 per hour for low fire rates and 36 per hour for high fire rates.

In comparison, the sealed plenum chamber used in the catalytic heater of the invention is capable of between about 200 volume changes per hour at 3 cubic feet of gas flow per square foot per hour (low fire) and 800 volume changes at 6 cubic feet of gas flow per square foot per hour (high rate). By dramatically increasing the number of hourly volume changes, the catalytic heater of the invention is far more responsive to volume changes, providing rapid stabilization when changing from one flow rate to another as directed by system controller 85 and catalytic heater controller 83.

The perforated plate used in prior art catalytic heaters typically has an "open area" of about 50 percent (%). In essence, this means that for every square foot of plate, there are 72 square inches of open area, and 72 square inches of closed area.

In the catalytic heater of the invention, the large open area perforated plate of the prior art has been replaced with a smaller open area perforated plate, which not only serves to form a sealed plenum chamber as described, but in addition provides an open area of between about 0.009 and 0.06 percent (%) of the total area of the plate, with an average open area of about 0.03 percent (%), for example. The perforated plate in the present heater is sealed to the bottom of the heater pan, and replaces the gas distribution tubes often used in commercial heaters.

Figure 5:
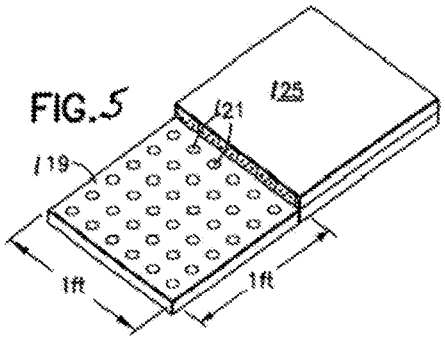
FIG. 5 is a perspective view of the perforated plate and porous baffle number used in the gas catalytic heater shown in FIGS. 3 and 4.

In terms of numbers, the 0.03% average open area provided by the present perforated plate is equal to about 0.0432 square inches of open area per square foot as compared to the 72 square inches on conventional heaters. This represents a reduction by over 1600 times from what has been standard practice in the catalytic heater industry. The average open area of 0.0432 square inches per square foot is the sum of the area of between 20 to 40 holes or apertures per square foot in the perforated plate 119 of the invention. Such a configuration is represented in FIG. 5 wherein there is shown a total of 36 holes or apertures 121 (6 by 6 rows) in one square foot of plate area. It is important to note that the size of the holes or apertures 121 are shown in the drawings (FIGS. 3-5) on a much larger scale than might actually be employed in practice merely for the purposes of illustration.

Gas enters the sealed plenum chamber 118 through a pre-sized gas orifice 122. The purpose of the orifice is to limit the volume of gas entering the plenum chamber 118 for a given pressure of gas from a suitable supply (not shown). The pressure drop across orifice 122 is equal to the pressure prior to the orifice minus the pressure in plenum chamber which is typically less than about 0.5 of a Water Column inch. In other words, by placing a sensitive pressure measuring device over any of the 20-40 apertures 121 in the perforated plate 119, a pressure of around 0.5 Water Column inches will register on the pressure gage. The pressure will be higher as the flow of gas is increased into plenum chamber 118 and will decrease when the flow of gas is decreased into plenum chamber. At any flow rate, the pressure remains the same at any of the 20-40 apertures per square foot, thereby ensuring an equal flow of gas through each of the apertures per square foot across the entire surface of plate 119 regardless of its total or overall surface area.

As the gas flows through the holes or apertures 121, it has a velocity perpendicular to the perforated plate 119. The velocity is greater at higher gas inputs into the catalytic heater and lower with less gas entering the heater. In order to ensure that the velocities remain the same at each of the apertures, it is essential to keep the apertures open and free from contact with other materials within the heater, particularly the fibers within the insulating layers 123, 124. Additionally, once the gas has cleanly exited each aperture, the gas velocity is reduced and redirected partially parallel to plate 119. To assure that these conditions are met, a woven or non-woven baffle member 125 is provided according to the invention. The baffle separates the insulation material from the plate 119 and prevents the apertures from becoming blocked by the insulation.

It has not been possible with the prior art catalytic heaters to evenly disperse low fire or low flow of gas at 2 cubic feet/hour over 1 square foot of heater/catalyst surface. This can be achieved, however, with the catalytic heater of the invention which disperses the fuel gas into a horizontal plane at the plenum chamber, as opposed to prior art heaters that use tubular arrangements. These tubular arrangements have holes through which the gas exits that are typically on 4-6 inch centers and point down away from the catalyst. The gas hits the back of the heater and reverses up towards the catalyst. In the catalytic heater of the invention using a plenum chamber, the gas exits the perforated plate directly to a baffle and then to the catalyst. The tubular arrangement of the prior art employs 1-4 holes per square foot on average. The holes are about an ⅛ inch (0.125 inch) in diameter.

Natural gas which constitutes the majority of the fuel used with catalytic heaters, has a specific gravity of 0.65. As such, it is very light and difficult to disperse evenly into the catalyst. The plenum depth and hole diameters in the present catalytic heaters are adapted to provide a suitable gas velocity as it exits the plenum chamber. Too much velocity and the gas "squirts" through the catalyst not allowing enough resonance time for the gas to be chemically oxidized by the platinum in the catalyst bed.

A sealed plenum, by definition, exerts equal pressure in all directions within the plenum. Therefore, if the holes in perforated plate are all of equal diameter, then the same flow or velocity of gas will take place at every hole. This concept has been demonstrated by tests wherein the gas is lighted as it exits the plate. All the flames were the same height. The height increases from a low at 2 cubic feet/hour/sq. ft. to a high at 8 cubic feet/hour/sq. ft.

Catalytic heaters of the invention consistently demonstrate improved methane slip rates as compared to catalytic heaters of the prior art. Prior catalytic heaters have shown methane slip rates up to as high as 25 percent (%) at typical operating levels of about 15 percent (%). With the improved catalytic heater of the invention, the catalyst receives the gas in an even, consistent flow across the entire surface of the heater. As a result, there is a consistent chemical reaction that takes place at the catalyst layer. This in turn produces an even temperature across the entire heater surface.

In the prior catalytic heaters, gas is unevenly distributed causing varying quantities of the gas to react with the catalyst. As a result, non-uniform temperature distributions and "cold spots" occur on the working element. It is in the areas where larger quantities of fuel gas contact the catalyst and cannot be chemically reacted, that is, at high gas flow rates, that methane slippage most frequently occurs. Laboratory testing of catalytic heaters made according to the invention have shown methane slippage to be less than about 5 percent (%) of the input levels. The gas dispersion system of the invention this allows the catalytic reaction to be more efficient in converting the BTUs of the gas into heating energy. Because of this increased efficiency, greater heat outputs are possible with the catalytic heaters of the invention. In addition, methane slippage may even be even further reduced as the output is increased. Thus, whereas the slip rate is about 5 percent (%) at 6000 BTUs output, the slippage may be reduced to as little as about 3 percent (%) at 8000 BTUs.

Figure 8:
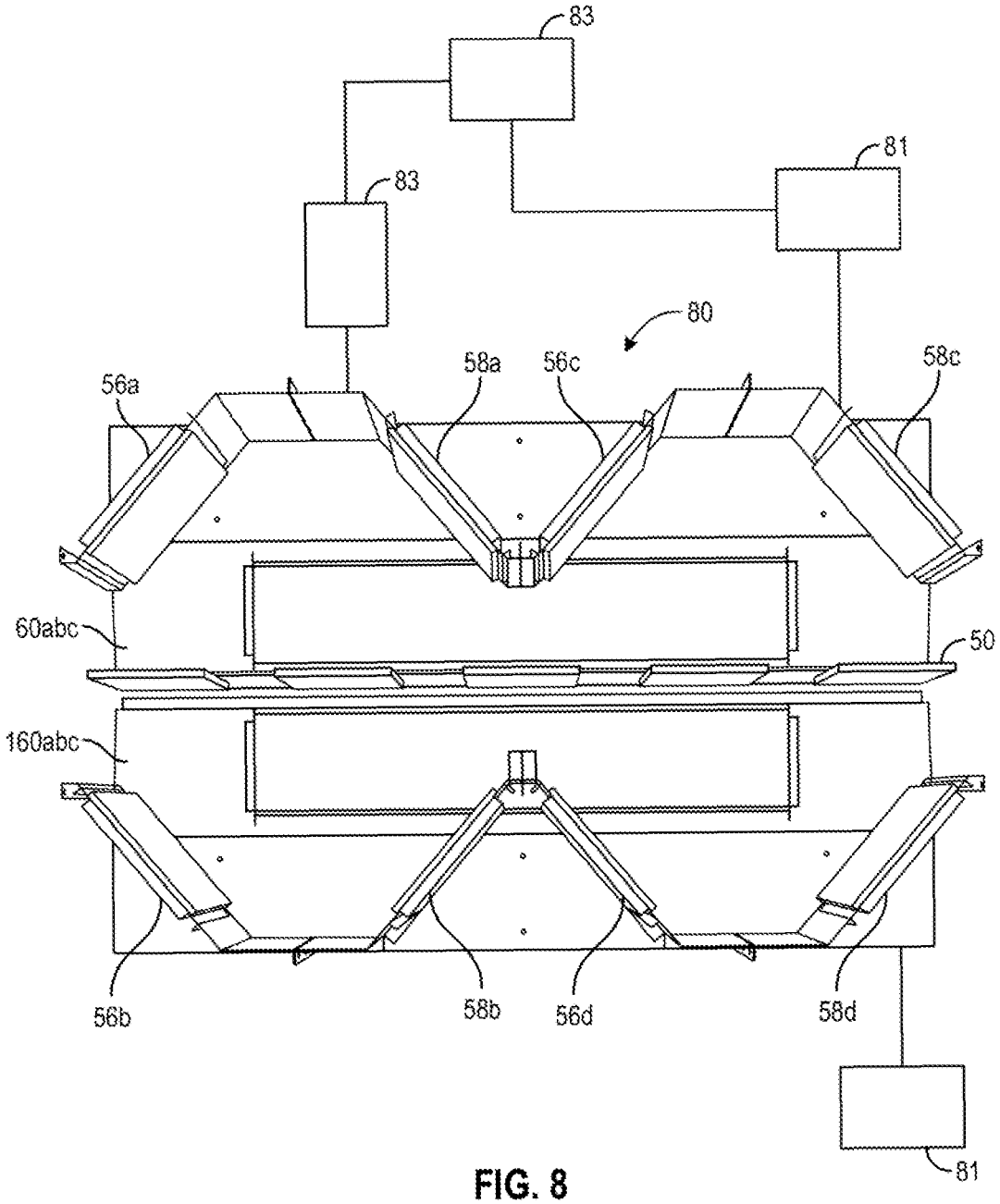
FIG. 8 is a top down cutaway view of one configuration of the invention shown in FIG. 1.

Referring also to FIG. 8, there is shown a top-down cutaway view of one configuration of the present invention shown in FIG. 1. It will be appreciated that each of the catalytic heater elements 56*a*, 58*a*, 56*c*, 58*c*, 56*b*, 58*b*, 56*d*, and 58*d*, described herein, may be adjusted, or rotated, to independent angles relative to the MDF board 50. Similarly, each of the catalytic heater elements may be set to output different BTUs by system controller 85.

Figure 9:
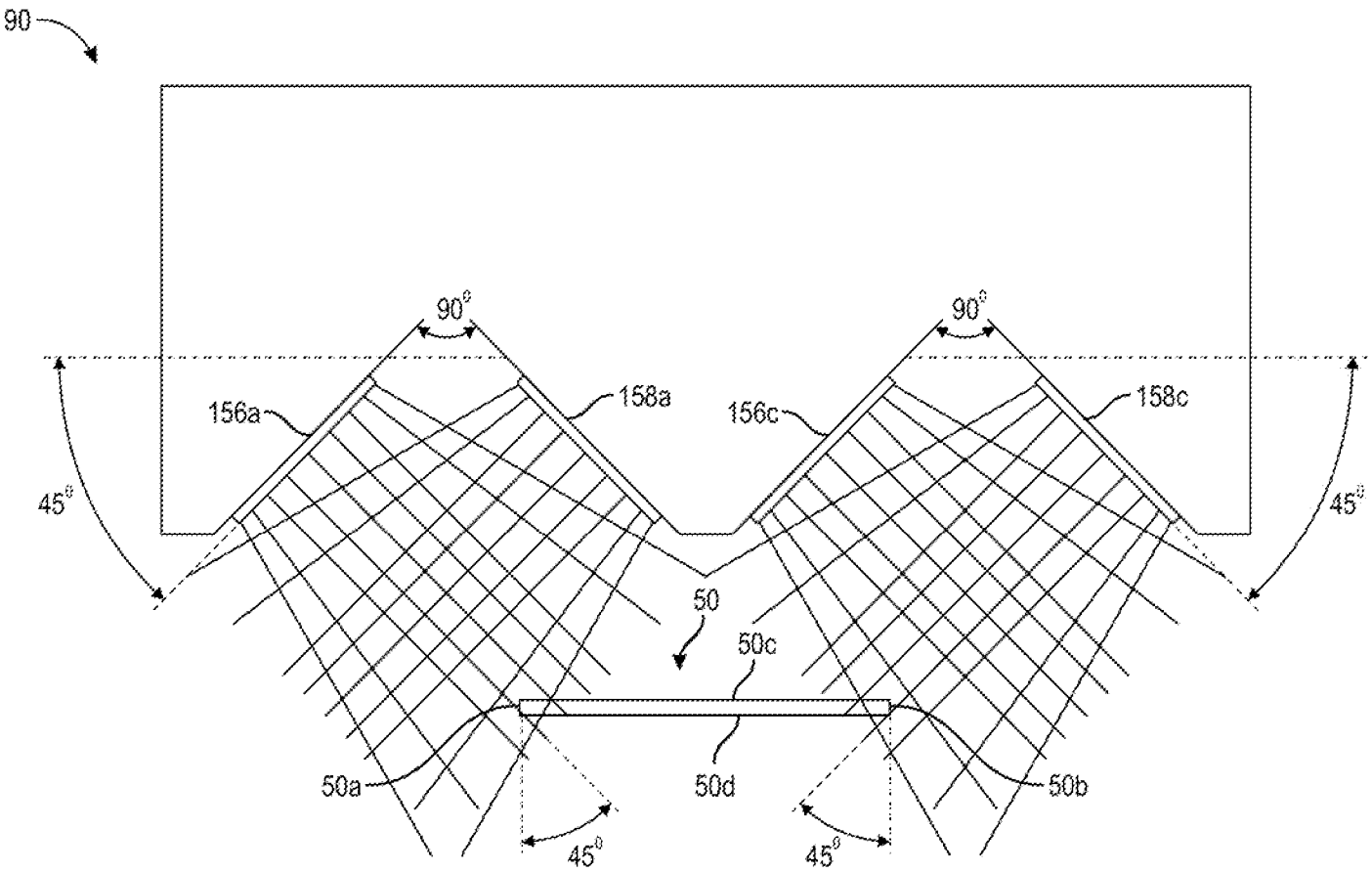
FIG. 9 is a top down diagram view of infrared heat vectors heating an MDF board at a 45 degree angle of incidence in one half of a catalytic oven in accordance with the invention shown in FIG. 8.

Referring also to FIG. 9 there is shown a top down diagram view of infrared heat vectors heating an MDF board 50 at a 45 degree angle of incidence in one half of a catalytic oven in accordance with the invention shown in FIG. 8. As noted earlier, each of the catalytic heater elements may be independently adjusted.

Figure 10:
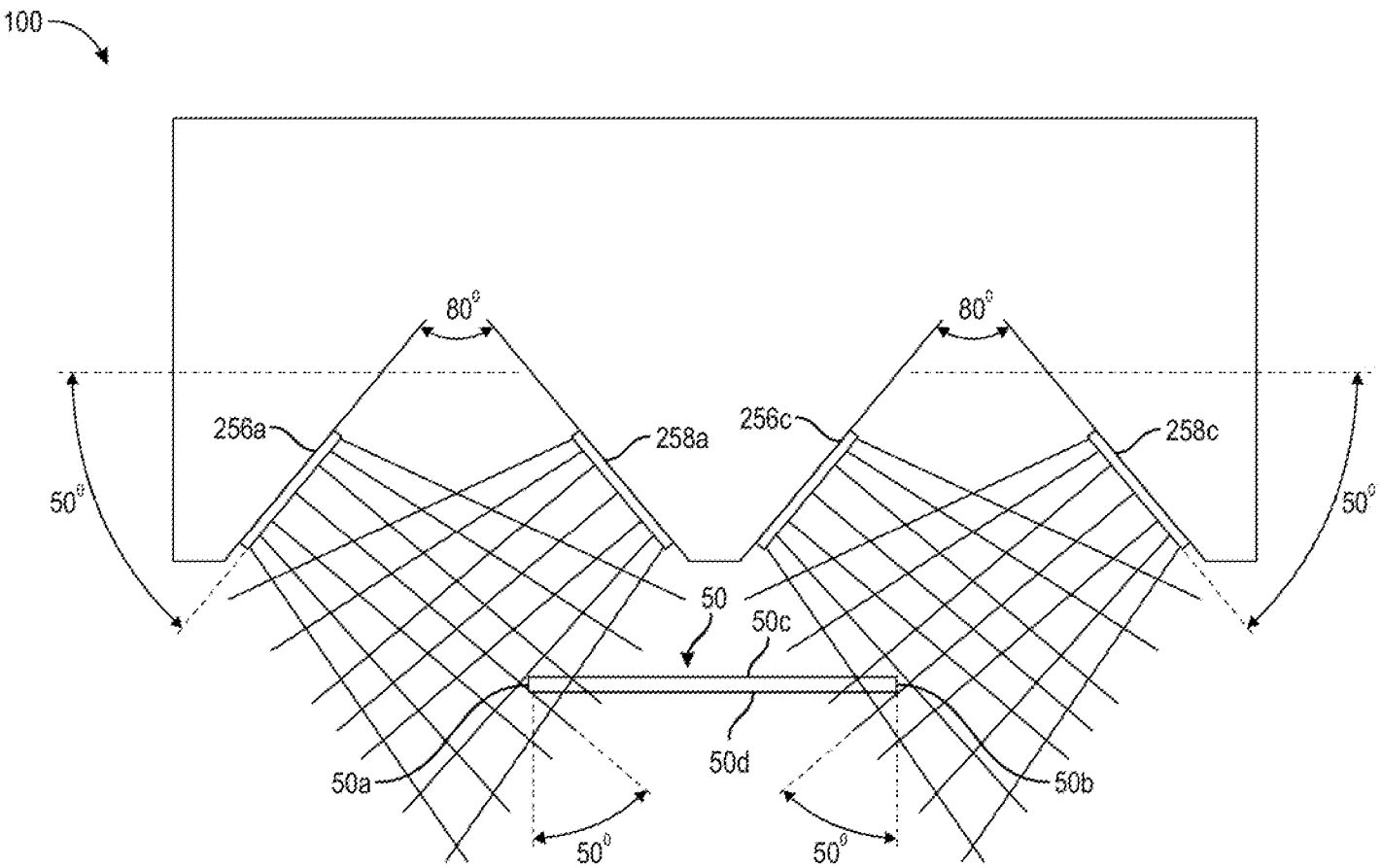
FIG. 10 is a top down diagram view of infrared heat vectors heating an MDF board at a 50 degree angle of incidence in one half of a catalytic oven in accordance with the invention shown in FIG. 8.

Referring also to FIG. 10 there is shown a top down diagram view of infrared heat vectors heating an MDF board 50 at a 50 degree angle of incidence in one half of a catalytic oven in accordance with the invention shown in FIG. 8. As noted earlier, each of the catalytic heater elements may be independently adjusted.

Figure 11:
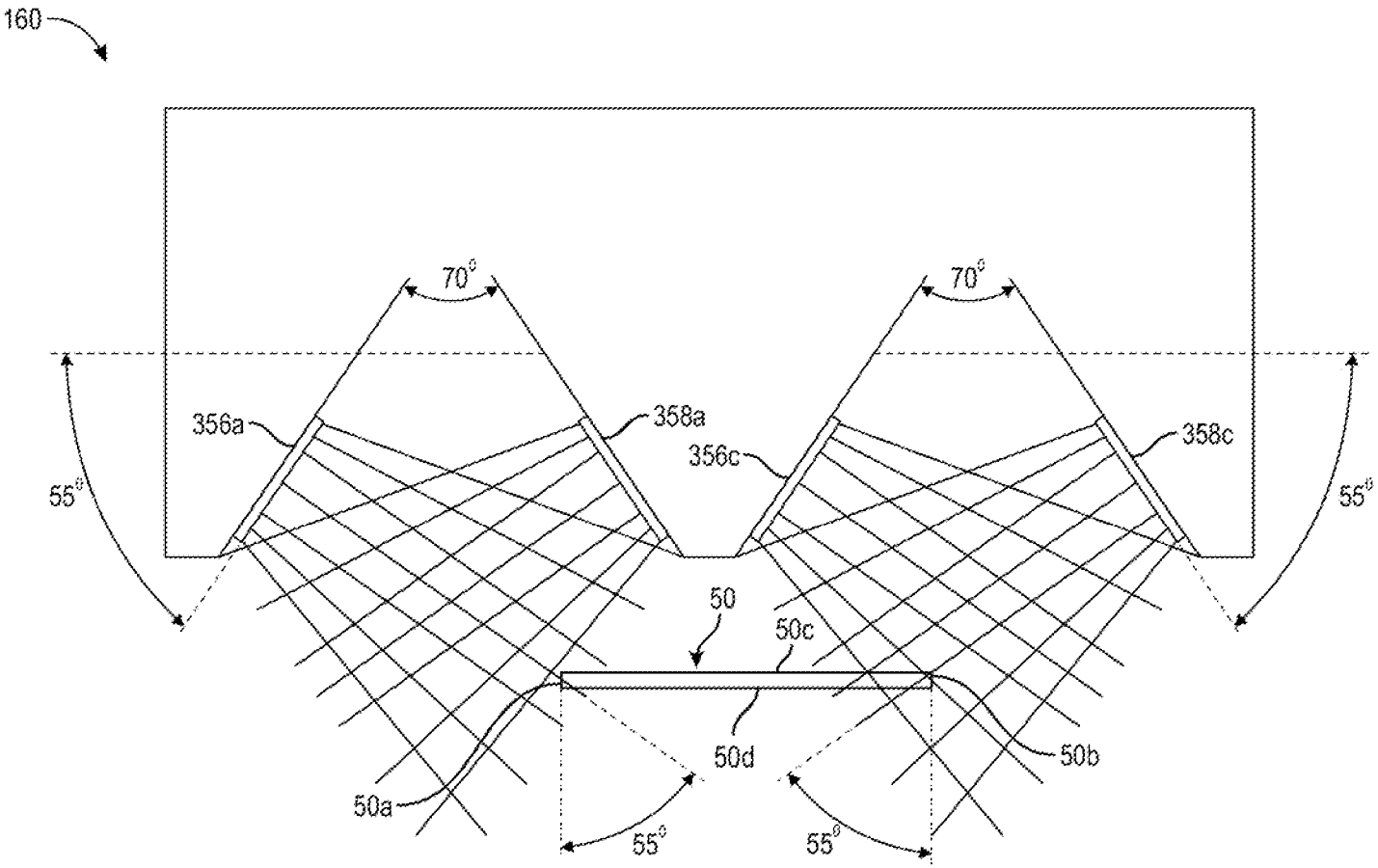
FIG. 11 is a top down diagram view of infrared heat vectors heating an MDF board at a 55 degree angle of incidence in one half of a catalytic oven in accordance with the invention shown in FIG. 8.

Referring also to FIG. 11 there is shown a top down diagram view of infrared heat vectors heating an MDF board 50 at a 55 degree angle of incidence in one half of a catalytic oven in accordance with the invention shown in FIG. 8. As noted earlier, each of the catalytic heater elements may be independently adjusted.

It will be understood that the catalytic heater elements may be set such that the angle of incidence of infrared heat vectors heating MDF board 50 is any suitable angle of incidence.

In summary, the invention provides a substantial improvement in catalytically powered ovens wherein infrared catalytic heaters are inclined on a vertical axis to apply infrared energy directly at the vertical edges of the MDF board. Along with adjustable angles of incidences of infrared heat and individually adjustable heater elements the invention provides an overlapping three dimensional gradient heat zone. The net result reduces the direct infrared energy from heating up the board face and thus reducing the out-gassing, while directing infrared heat proportionally towards the edges and faces of the MDF board 50 causing the powder coating to cure at the same rate as the face of the board, thereby preventing bubbling and blister formation.

Additionally, the section headings used herein are provided for consistency with the suggestions under 37 C.F.R. 1.77 or to otherwise provide organizational cues. These headings shall not limit or characterize the invention(s) set out in any claims that my issue from this disclosure. Specifically and by way of example, although the headings might refer to a "Field," the claims should not be limited by the language chosen under this heading to describe the so-called field. Further, a description of a technology in the "Background" is not to be construed as an admission that certain technology is prior art to any invention(s) in this disclosure. Neither is the "Summary" to be considered as a limiting characterization of the invention(s) set forth in issued claims. Furthermore, any reference in this disclosure to "invention" in the singular should not be used to argue that there is only a single point of novelty in this disclosure. Multiple inventions may be set forth according to the limitations of the multiple claims issuing from this disclosure, and such claims accordingly define the invention(s), and their equivalents, that are protected thereby. In all instances, the scope of the claim shall be considered on their own merits in light of this disclosure, but should not be constrained by the headings set forth herein.

Finally, it will be understood that use of broader terms such as comprises, includes, and having should be understood to provide support for narrower terms such as consisting of consisting essentially of, and comprised substantially of. Use of the term "optionally," "may," "might," "possibly," and the like with respect to any element of an embodiment means that the element is not required, or alternatively, the element is required, both alternatives being within the scope of the embodiment(s). Also, references to examples are merely provided for illustrative purposes, and are not intended to be exclusive.

The sealed plenum chamber (see FIG. 3—118) having a wall portion facing toward the catalytically active layer (see FIG. 3—116) wherein the wall, portion of the sealed plenum chamber (see FIG. 3—118) comprises a solid perforated member (see FIG. 3—119) having an open area of between about 0.009 and about 0.06 percent of the entire surface provided by the apertures area of the perforated member (see FIG. 3—116), wherein the wall portion contains a plurality of tiny, substantially equally spaced apart apertures having a diameter of between about 0.02 and 0.1 inch for the passage of a combustible gas there through, The improvement in combination therewith of a porous baffle member disposed between the insulating layer and the wall portion for distributing portions of the gas in a direction substantially parallel to the wall portion after passing through the apertures, the baffle member also separating the wall portion from the insulating layer and prohibiting the fibers from entering and blocking the apertures to the passage of gas there through.

The solid perforated member (see FIG. 3—119) comprises a metal plate having between about 20 and 40 apertures (see FIG. 3—121) per square foot of the plate. The sum of the open area provided by the apertures being between about 0.013 and 0.085 square inches per square foot.

At least one dynamic system parameter comprises a cure rate associated with the powder coating.

At least one dynamic system parameter may also comprise a conveyor rate in unit length per unit time conveying the powder coated wood product through the three dimensional temperature gradient field.

What is claimed is:

1. An apparatus with a system controller for generating three dimensional infrared gradient heating fields for curing powder coating on a three dimensional powder coated wood product, wherein the three dimensional powder coated wood product includes multiple relatively lower and higher density zones, and wherein the powder coated wood product is conveyed through the apparatus by a conveyor, the apparatus comprising:

at least one first catalytic heater element for generating infrared heat incident upon the powder coated wood product;

at least one second catalytic heater element for generating infrared heat incident upon the powder coated wood product;

wherein the at least one first catalytic heater element and the at least one second catalytic heater element are disposed within the apparatus to generate a three dimensional gradient heating zone when the heater elements are operational; and wherein the at least one first catalytic heater element and the at least one second catalytic heater element are each independently adjustable by the system controller to change the infrared heat generated by each catalytic heater:

wherein the at least one first catalytic heater element the at last one second catalytic heater element each comprise:

a catalytically active porous layer disposed within the heater element;

at least one heat insulating layer containing fibers disposed below the catalytically active porous layer; and a sealed plenum chamber having a wall portion facing toward said catalytically active layer wherein said wall portion of said sealed plenum chamber comprises a solid perforated member having an open area of between 0.009 and 0.06 percent of the entire surface provided by a plurality of tiny, substantially equally spaced apart apertures haying a diameter of between 0.02 and 0.1 inch for the passage of a combustible gas there through, in combination therewith of a porous baffle member disposed between said insulating layer and said wall portion for distributing portions of said gas in a direction substantially parallel to said wall portion after passing through said apertures, said baffle member also separating said wall portion from said insulating layer and prohibiting said fibers from emeriti and blocking said apertures to the passage of gas there through.

2. The apparatus as in claim 1 wherein the at least one first catalytic heater element and the at least one second catalytic heater element are each independently adjustable by the system controller to change the angle of incidence of the generated infrared heat incident upon the powder coated wood product.

3. The apparatus as in claim 1 wherein said solid perforated member comprises a metal plate having between about 20 and 40 apertures per square foot of said plate, the sum of the open area provided by said apertures being between about 0.013 and 0.085 square inches per square foot.

4. The apparatus as in claim 3, wherein the volume of said plenum chamber is sufficient to permit between about 200 volume changes per hour at a gas flow rate of about 3 cubic feet per square foot per hour and 800 volume changes at a gas flow rate of about 6 cubic feet per square foot per hour.

5. The apparatus as in claim 4 wherein the system controller adjusts independent gas flow rates through each of the at least one first catalytic heater elements and the at least one second catalytic heater elements, wherein the independent gas flow rates result in a three dimensional temperature gradient field, wherein the three dimensional temperature gradient field is adaptable to substantially cure coatings within the relatively lower density zones before curing coatings within the higher density zones.

6. The apparatus as in claim 5 wherein the controller is adaptable to adjust the independent gas flow rates in response to temperature sensing.

7. The apparatus as in claim 6 wherein the controller is adaptable to adjust the independent gas flow rates in response to specifications associated with the powder coated wood product.

8. The apparatus as in claim 6 wherein the controller is adaptable to adjust the independent gas flow rates in response to actual or predicted conveyor speeds.

9. A system for generating three dimensional infrared gradient heating fields for curing power coating on a powder coated wood product, wherein the powder coated wood product includes multiple relatively lower and higher density zones, and Wherein the powder coated wood product is conveyed through the system by a conveyor, the system comprising:

a plurality of plenum chambers, wherein each of the plurality of plenum chambers is sufficient to permit between about 200 volume changes per hour at a gas flow rate of about 3 cubic feet per square foot per hour and 800 volume changes at a gas flow rate of about 6 cubic feet per square foot per hour;

a system controller for independently adjusting gas flow rate to 3 cubic feet per square foot per hour or 6 cubic feet per souare foot per hour through each of the plurality of plenum chambers;

a plurality of catalytically active layers, each of the plurality of catalytically active layers in gaseous communication with a corresponding one of the plurality of plenum chambers, wherein the plurality of catalytically active layers are disposed relative to each other to generate a three dimensional infrared heat field; and wherein the independent gas flow rates and the disposition of the plurality of catalytically active layers result in a three dimensional temperature gradient field, wherein the three dimensional temperature gradient field is adaptable to substantially cure powder coatings within the relatively lower density zones before curing powder coatings within the higher density zones.

10. The system as in claim 9 wherein the system controller is adaptable to adjusting the independent gas flow rates in accordance with at least one dynamic system parameter.

11. The system as in claim 10 wherein the at least one dynamic system parameter comprises a cure rate associated with the powder coating.

12. The system as in claim 10 wherein the at least one dynamic system parameter comprises a conveyor rate in unit length per unit time conveying the powder coated wood product through the three dimensional temperature gradient field.

13. The system as in claim 9 wherein the three dimensional temperature gradient field is generated by the plurality of catalytically active layers is adaptable to impinge at a substantially 45 degrees to substantially 55 degrees angle of incidence to the powder coated wood product.

14. An apparatus with a system controller for generating three dimensional infrared gradient heating fields for curing powder coating on a three dimensional powder coated wood product, wherein the three dimensional powder coated wood product includes a plurality of differing density zones, and wherein the powder coated wood product is conveyed through the apparatus by a conveyor, the apparatus comprising:

at least one first catalytic heater element for generating infrared heat incident upon the powder coated wood product at a first incidence angle;

at least one second catalytic heater element for generating infrared heat incident upon the powder coated wood product at a second incidence angle; and wherein the at least one first catalytic heater element and the at least one second catalytic, heater element are cooperatively disposed within the apparatus to generate proportional three dimensional gradient heating zones when the heater elements are operational;

wherein the proportional three dimensional temperature heating zones are adaptable to substantially cure powder coatings within the relatively lower density zones before curing powder coatings within the higher density zones as the powder coated wood product is conveyed through the three dimensional temperature heating zones; and wherein the at least one first catalytic heater element and the at least one second catalytic heater element each comprise:

a catalytically active porous layer disposed within the heater element;

at least one heat insulating layer containing fibers disposed below the catalytically active porous layer; and a sealed plenum chamber having a wall portion facing toward said catalytically active layer wherein said wall portion of said sealed plenum chamber comprises a solid perforated member having an open area of between 0.009 and 0.06 percent of the entire surface provided by a plurality of tiny, substantially equally spaced apart apertures haying a diameter of between 0.02 and 0.1 inch for the passage of a combustible gas there through, in combination therewith of a porous baffle member disposed between said insulating layer and said wall portion for distributing portions of said gas in a direction substantially parallel to said wall portion after passing through said apertures, said baffle member also separating said wall portion from said insulating layer and prohibiting said fibers from entering and blocking said apertures to the passage of gas there through.

15. The apparatus as in claim 14 wherein the system controller determines gas flow rate through the at least one first catalytic heater element and the at least one second catalytic heater element according to predetermined temperature characteristics.

16. The apparatus as in claim 14 wherein the system controller determines gas flow rate through the at least one first catalytic heater element and the at least one second catalytic heater element according to dynamic temperature characteristics.

17. The apparatus as in claim 14 wherein each sealed plenum chamber is sufficient to permit between about 200 volume changes per hour at a gas flow rate of about 3 cubic feet per square foot per hour and 800 volume changes at a gas flow rate of about 6 cubic feet per square foot per hour.

* * * * *